US007730839B1

(12) United States Patent
Bender et al.

(10) Patent No.: US 7,730,839 B1
(45) Date of Patent: Jun. 8, 2010

(54) INTERFACIAL STRESS REDUCTION AND LOAD CAPACITY ENHANCEMENT SYSTEM

(75) Inventors: James M. Bender, Bel Air, MD (US); James M. Sands, Kingsville, MD (US); Robert B. Dooley, Canton, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 751 days.

(21) Appl. No.: 11/709,734

(22) Filed: Feb. 23, 2007

(51) Int. Cl.
*F42B 8/00* (2006.01)

(52) U.S. Cl. ..... 102/501; 102/473; 248/351; 248/354.3; 405/288

(58) Field of Classification Search ..... 102/473, 102/501; 248/351, 354.3; 52/223.13, 223.14, 52/223.4, 170, 831; 405/288
See application file for complete search history.

(56) References Cited

U.S. PATENT DOCUMENTS 2,160,454 A * 5/1939 Bucky ..... 248/354.3
4,009,720 A 3/1977 Crandall
4,281,487 A * 8/1981 Koller ..... 52/167.1
4,664,427 A 5/1987 Johnston
5,125,148 A 6/1992 Krasnov
5,165,040 A * 11/1992 Andersson et al. ..... 102/464
5,275,246 A 1/1994 Krasnov
6,056,480 A * 5/2000 Kolk ..... 405/290
6,510,895 B1 1/2003 Koleilat et al.
6,536,990 B2 * 3/2003 Schubert et al. ..... 405/150.1
2007/0068415 A1 * 3/2007 Oertwig ..... 102/509

* cited by examiner

*Primary Examiner*—Michael Carone
*Assistant Examiner*—Gabriel J Klein
(74) *Attorney, Agent, or Firm*—William W. Randolph; Edward L. Stolarun; Guy M. Miller

(57) ABSTRACT

An article and a process are provided for reducing the shear stress on an interface of a structural member in intimate contact with a compressive load. The article is in the form of a wedge that is forcibly placed against the sidewall of one end or both ends of the structural member. The wedge may take the form of a ring that can be placed on the inside or outside surface of a hollow cylindrical structural member. The process of forcibly placing a wedge against the sidewall at one or both ends of the structural member produces a transverse compressive stress upon the sidewall. The transverse compressive stress upon the sidewall attenuates the tendency of said sidewall to deflect when the structural member is subjected to a compressive load. A reduction in the deflection of the sidewall reduces the shear stress generated proximal to the interface of the structural member in intimate contact with a compressive load and increases the structural member load bearing capacity.

20 Claims, 3 Drawing Sheets

INTERFACIAL STRESS REDUCTION AND LOAD CAPACITY ENHANCEMENT SYSTEM

GOVERNMENT INTEREST

The invention described herein may be manufactured, used, and licensed by or for the United States Government.

FIELD OF THE INVENTION

The present invention relates in general to a system and a process that applies a compressive stress to a structural member and in particular to a system and process that applies a transverse compressive stress to a structural member and reduces interfacial stresses at a the structural member interface in contact with a compressive load.

BACKGROUND OF THE INVENTION

Structural members can be placed under significant compressive loads. The use of structural members in bridges, buildings, maritime and aerospace equipment, and munitions can result in catastrophic damage, exorbitant cost and even loss of life when such a member fails.

The interface between a structural member and a load supported by said structural member is a critical location with respect to failure. Such interfaces are often the weak link of a complex structure.

Hollow structural members subjected to a compressive load can experience a "barreling" phenomenon wherein deflection of a structural member sidewall occurs in a lateral direction. This barreling causes deformation to the structural member and can result in shear stresses proximal to the interface between the structural member and the load and/or the base in contact with the member. The interfacial shear stresses can be of such magnitude that failure of the structural member results.

Metal matrix composite materials, for example an aluminum alloy matrix with ceramic fibers therein, provide a substantial weight savings and improved structural integrity over current traditional structural materials such as steels and aluminum alloys. The weight savings obtained by using metal matrix composite materials can immediately be reinvested into other areas of concern, particularly in situations where a weight to strength ratio is critical such as aerospace and munition applications. Therefore, metal matrix composite materials continue to be tested and used in an increasing number of commercial, industrial and military applications. However, the use of a metal matrix composite material as a structural member can create a problem with respect to joining the member to the load it supports, with traditional joining methods such as welding, bolting, screwing, etc., proving difficult if not impossible. With the difficulty of joining a metal matrix composite structural member to another member in a given structure, interfacial integrity becomes an even more important issue.

Therefore, given the criticality of structural member interfaces and the loads said members support, there is a need for an article and a process that reduces the interfacial stresses occurring at interfacial locations.

SUMMARY OF THE INVENTION

A system is provided for the reduction of shear stress at a hollow structural member interface. The system is in the form of a wedge that is forcibly placed against the sidewall at one end or both ends of a structural member subjected to a compressive load. The wedge may take the form of a ring or ring segments and can be used with a supporting block or at least one other wedge in order to produce a transverse compressive force on the sidewall of the structural member. The system also provides for a fastening joint that supports tensile loads.

A process for reducing the shear stress at a hollow structural member interface includes forcibly placing a wedge against the sidewall at one or both ends of a structural member subjected to a compressive load. Forcibly plabing the wedge against the sidewall of the structural member produces a transverse compressive stress on the sidewall. The transverse compressive stress on the sidewall attenuates the tendency of the sidewall to deflect in a lateral direction when the structural member is placed under a compressive load. By reducing the deflection of the sidewall, the transverse compressive stress reduces the shear stress proximal to the interface of the structural member that is in intimate contact with the compressive load and increases its load bearing capacity. Reducing the interfacial shear stresses of the structural member increases the safety and reliability of the structural member and the entire structure.

DETAILED DESCRIPTION OF THE PREFERRED EMBODIMENTS

The present invention has utility as a system and a process for reducing interfacial shear stresses proximal to a structural member interface in physical contact with a compressive load. Representative manifestations of the present invention include reducing shear stresses at structural member interfaces in bridges, buildings, maritime and aerospace equipment, and munitions.

Figure 1:
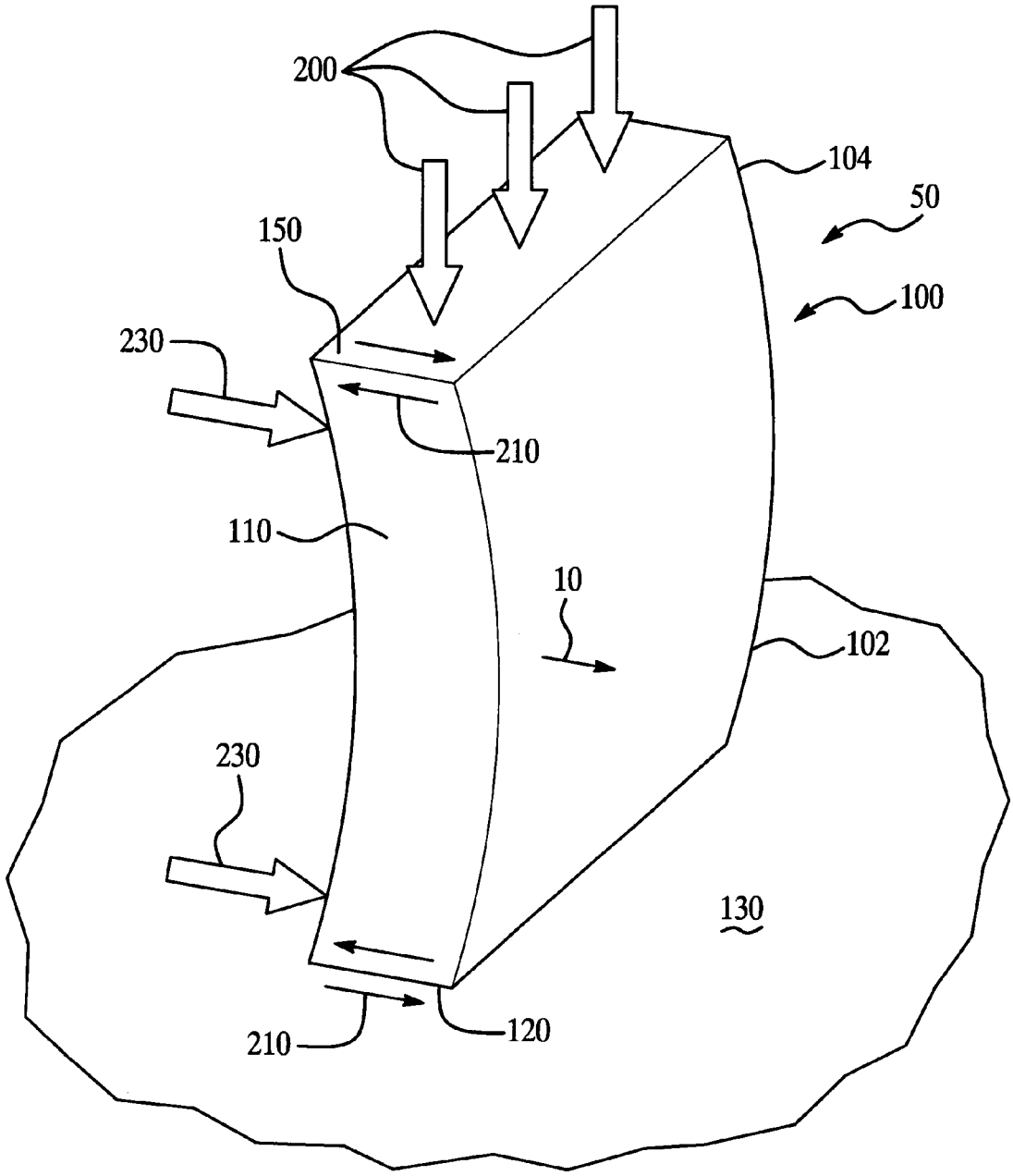
FIG. 1 is a perspective view of a single structural member with sidewall deflection in a first direction.

Referring now to FIG. 1, an inventive process is applied to a structural member 100 shown generally at 50. The structural member is readily formed of any material conventional to the art, such materials operative herein illustratively including metals, alloys, plastics and composites. A transverse compressive force 230 is applied to a structural member sidewall 110 of the member 100. The structural member 100 has a first end 102 separated from a second end 104 by the sidewall 110. An interface 120 is located at the first end 102 of the structural member 100 and an interface 150 is located at the second end 104. The interface 120 is in physical contact with a base 130 and the interface 150 is in physical contact with a longitudinal compressive load 200. The "longitudinal compressive load" as used herein is defined as a compressive load applied to a structural member along a direction normal to an interface in physical contact with either the load or a base supporting the member and the load.

The longitudinal compressive load 200 produces a deflection of the sidewall 110 in a first direction 10. Deflection of the sidewall 110 in the first direction 10 creates a shear stress 210 proximal to the interfaces 120 and 150. The inventive process applies the transverse compressive force 230 in the first direction 10 to attenuate the tendency of the sidewall 110 to deflect in the first direction 10. Decreasing the deflection of the sidewall 110 in the first direction 10 reduces the shear stress 210 proximal to the structural member interfaces 120 and 150. The reduction of the interfacial shear stress 210 decreases the likelihood of failure proximal to the interfaces 120 and 150, and increases the load bearing capacity of the structural member 100.

The system includes at least one wedge (not shown in FIG. 1), with the wedge transmitting the transverse compressive force 230 to the sidewall 110 of the structural member 100. The wedge is readily formed of any material conventional to the art, such materials operative herein illustratively including metals, alloys, plastics and composites. It is appreciated that factors involved in the selection of a wedge material include but are not be limited to, the compatibility of the wedge material with the structural member and the toughness, corrosion resistance and weldability of the wedge material.

In a preferred embodiment, the present invention includes the use of the system and the process to apply the transverse compressive force 230 before the longitudinal compressive load 200 is applied. This preloading at an appropriate location attenuates the tendency of the structural member sidewall 110 to barrel when subjected to the longitudinal compressive load 200. However, applying the transverse compressive force 230 to the structural member sidewall 110 after the longitudinal compressive load 200 has been applied is effective in reducing the interfacial shear stress 210.

Figure 2:
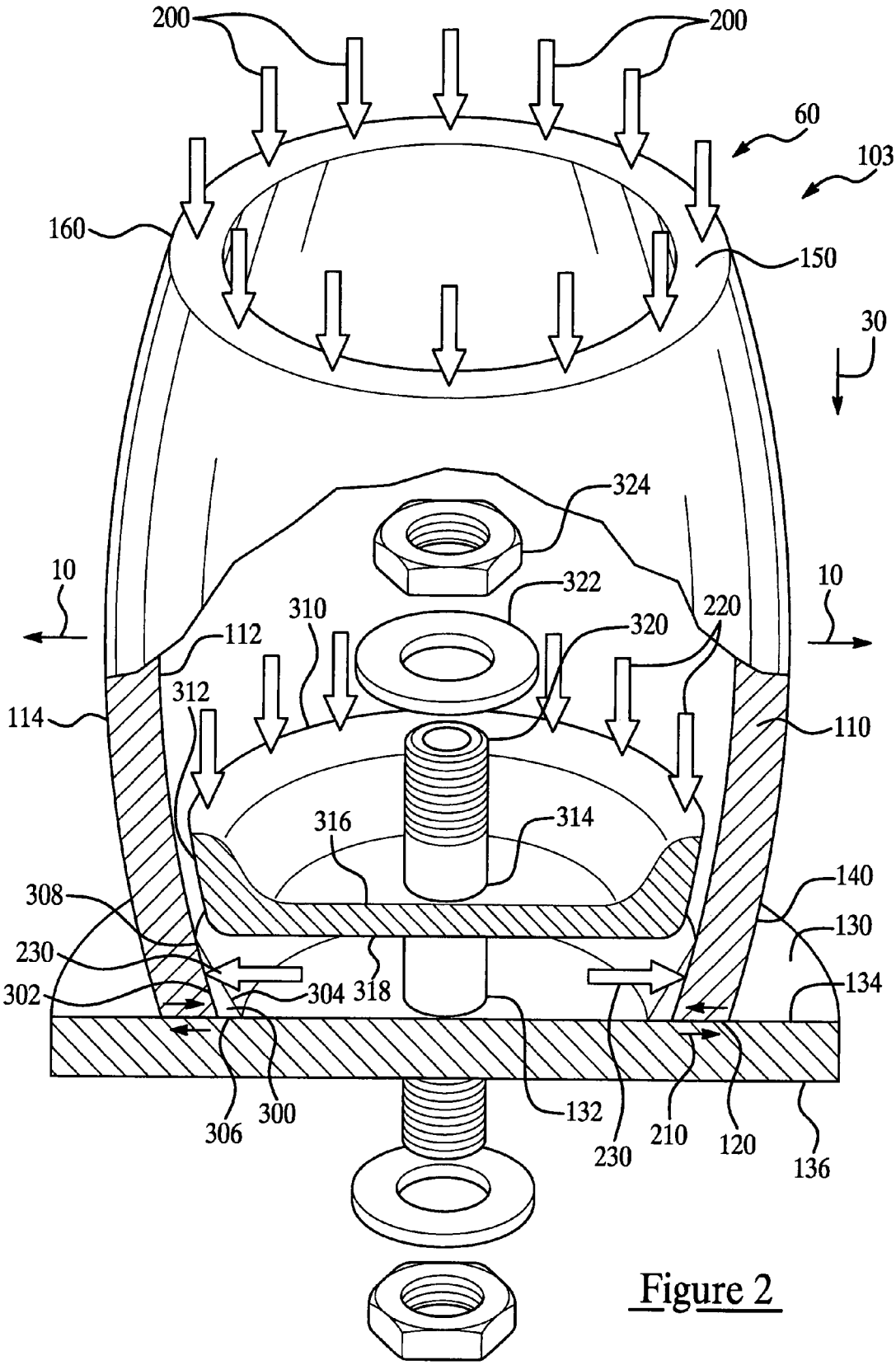
FIG. 2 is an exploded partial sectional view of a hollow structural member with sidewall deflection in a first direction.

Referring now to FIG. 2, an exemplary preferred embodiment of the present invention is shown generally at 60. A hollow cylindrical structural member 103 is positioned on a base 130. Preferably, the hollow cylinder is an artillery aeroshell. An aeroshell is an outer structural skin of a modern artillery projectile that provides a low-drag protection vehicle for the complex inner warhead and related components. It will be understood, however, that this is by way of example only and that any hollow cylindrical structural member may benefit from the system and process of the present invention.

The hollow cylindrical structural member 103 has a first end 140 and a second end 160. The first end 140 is separated from the second end 160 by the sidewall 110. The sidewall 110 has an inside surface 112 and an outside surface 114. An interface 120 is located at the first end 140 of the sidewall 110 and is in physical contact with the base 130. Likewise, an interface 150 is located at the second end 160 of the sidewall 110 and is in physical contact with the longitudinal compressive load 200. The longitudinal compressive load 200 on the hollow cylindrical structural member 103 causes deflection of the sidewall 110 in the first direction 10.

The base 130 has a top surface 134, a bottom surface 136 and an aperture 132. The top surface 134 supports the hollow cylindrical structural member 103 and is in physical contact with the interface 120.

A mating wedge 300 in the form of a ring is located adjacent to the inside surface 112 of the sidewall 110. It is appreciated that the wedge 300 is optimally provided by one or more ring segments. A wedge surface 302 is preferably parallel to the inside surface 112. The wedge surface 302 has a relief 303, said relief 303 affording the application of an adhesive to hold the wedge 300 in contact with the inside surface 112 during assembly. In the alternative, the wedge surface 302 does not have the relief 303. A thick end 306 of the wedge 300 is proximal to the interface 120 at the first end 140 of the sidewall 110. A thin end 308 is oppositely deposed from the thick end 306, thereby resulting in a reduction of the wedge 300 thickness between the thick end 306 and the thin end 308. The reducing thickness between the thick end 306 and the thin end 308 defines a taper. As shown in FIG. 2, the wedge 300 is permanently affixed to the sidewall 110. In the alternative, the wedge 300 is not permanently affixed to the sidewall 110.

An internal wedge block 310, also known as a driving wedge, is located within the hollow cylindrical structural member 103. It is appreciated that the internal wedge block 310 is optimally provided by one or more wedge block segments. An internal wedge block surface 312 of the internal wedge block 310 preferably matches the taper of the wedge 300, so as to place the internal wedge block surface 312 in parallel with the wedge surface 304.

The internal wedge block 310 has a top surface 316, a bottom surface 318 and an aperture 314. A threaded fastener 320 passes through the aperture 314 of the internal wedge block 310 and the aperture 132 of the base 130. Use of a washer 322, a nut 324 and the threaded fastener 320 affords a pull-down force 220 onto the internal wedge block 310. With the pull-down force 220 applied to the internal wedge block 310, the internal wedge block 310 moves in a third direction 30 and the internal wedge block surface 312 is in physical contact with the wedge surface 304. The internal wedge block surface 312 is preferably parallel to the wedge surface 304.

As the pull-down force 220 increases, the wedge action between the internal wedge block 310 and the wedge 300 produces the transverse compressive force 230 in the first direction 10. The transverse compressive force 230 attenuates the tendency of the sidewall 110 to deflect in the first direction 10. Reduction of the deflection of the sidewall 110 decreases the shear stress 210 proximal to the interface 120 and increases the load bearing capacity of the hollow cylindrical structural member 103. It is appreciated that the pull-down force 220, the wedge block 310 and the wedge 300 create a fastening joint between the hollow cylindrical structural member 103 and the base 130. It is also appreciated that the fastening joint supports a tensile load equal to the strength of the threaded fastener 320.

A preferred embodiment of the present invention uses the threaded fastener 320 with the washer 322 and the nut 324. Optionally, any system producing the pull-down force 220 on the internal wedge block 310 is used, illustratively including a clamp, weight or pry-bar system. It is appreciated that the sidewall 110 need not be part of a hollow cylindrical structural member. The sidewall 110 may be a single member, for example in the form of a sheet, rod or plate acting as a structural member as depicted in FIG. 1. In addition, although FIG. 2 illustrate the preferred embodiment affording a reduction of interfacial stresses at only on end of the hollow cylindrical structural member 103, the present invention can be used at both ends of the hollow cylindrical structural member 103.

Figure 3:
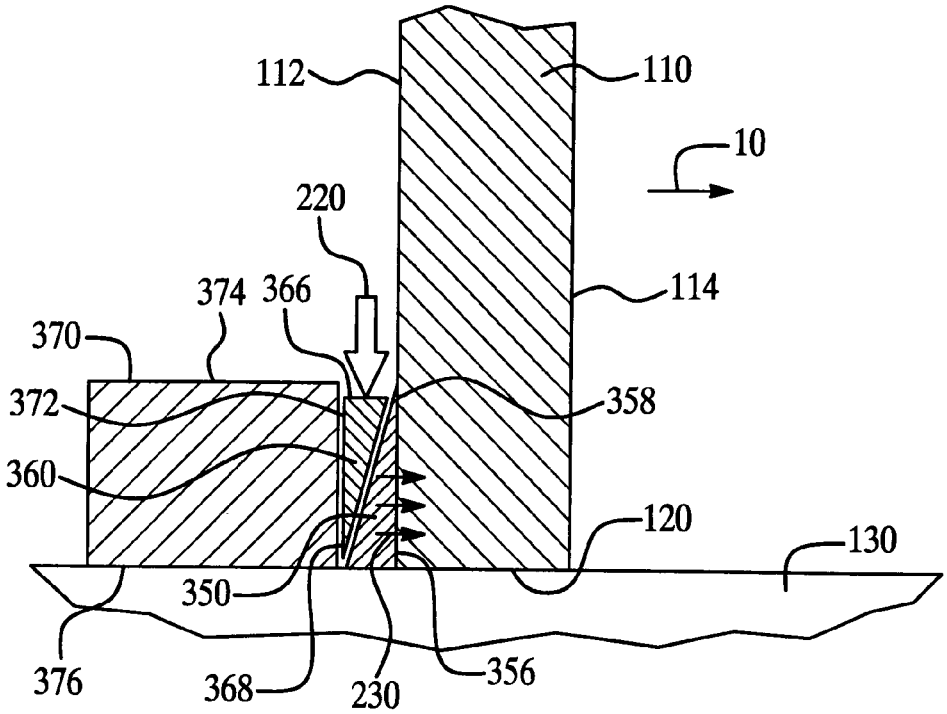
FIG. 3 is a sectional view of a sidewall with two wedges.

In FIG. 3, where like numerals correspond to those described in FIGS. 1-3, the wedge 300 and internal wedge block 310 described with respect to FIG. 2, are replaced with a first wedge 350, a second wedge 360 and a support block 370. The support block 370 has a wedge surface 372, a top surface 374 and a bottom surface 376. The bottom surface 376 is secured to the base 130 with the support block 370 located a distance apart from the inside surface 112 of the sidewall 110. The wedge surface 372 of the support block 370 is preferably parallel to the inside surface 112 of the sidewall 110.

The first wedge 350 can be similar in shape to the wedge 300 in FIG. 2. The second wedge 360 has a thick end 366 and a thin end 368 disposed oppositely therefrom. The second wedge 360 is inserted between the support block 370 and the first wedge 350 with the thin end 368 proximal to a thick end 356 of the first wedge 350. The pull-down force 220 on the second wedge 360 creates the transverse compressive force 230 on the inside surface 112 of the sidewall 110. Similar to the above described invention embodied in FIG. 3, the first wedge 350, second wedge 360 and support block 370 are optionally placed proximal to the outside surface 114 of the sidewall 110 and apply the transverse compressive force 250 to the sidewall 110.

Figure 4:
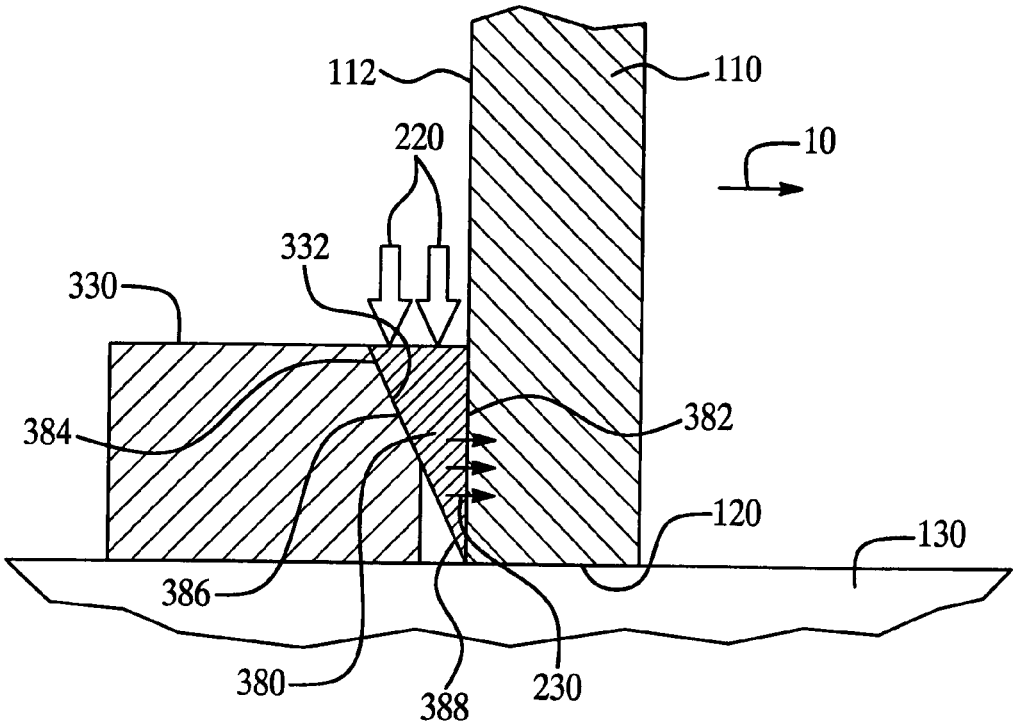
FIG. 4 is a sectional view of a sidewall with one wedge.

Turning now to FIG. 4, a support block 330 is located on the base 130 and secured thereto in a similar manner as the support block 370 in FIG. 3. The support block 330 is located a distance apart from the inside surface 112 of the sidewall 110. A wedge 380 has a thick end 386 and a thin end 388 oppositely disposed therefrom. The support block 330 has an inclined surface 392 forming an acute angle with the inside surface 112 of the sidewall 110. The wedge 380 is placed between the support block 330 and the sidewall 110 with the thin end 388 proximal to the base 130. A wedge surface 384 of the wedge 330 is preferably parallel to the inclined surface 392 of the support block 330. The pull-down force 220 on the wedge 380 moves the wedge in the third direction 30 and creates the transverse compressive force 230 exerted on the inside surface 112 of the sidewall 110. The transverse compressive force 230 on the inside surface 112 reduces the shear stress 210 proximal to the interface 120. Optionally, the support block 330 and the wedge 380 are placed proximal to the outside surface 114 and apply the transverse compressive stress 250 to the sidewall 110.

The foregoing description is illustrative of particular embodiments of the invention but is not meant to be a limitation upon the practice thereof. The following claims, including all equivalents thereof, are intended to define the scope of the invention.

The invention claimed is:

1. A system for reducing shear stress proximal to a hollow cylindrical structural member interface comprising:

a hollow cylindrical structural member having a sidewall, a first end and a second end, said member being subjected to a longitudinal compressive load that induces movement of the sidewall in the first direction; and a wedge forcibly placed against the first end to create a transverse compressive force on the sidewall in the first direction, so as to reduce shear stress proximal to the hollow cylindrical structural member interface.

2. The system of claim 1 wherein the hollow cylindrical structural member is a material selected from the group comprising of metals, alloys, plastics and composites.

3. The system of claim 1 wherein the hollow cylindrical structural member is a tube.

4. The system of claim 3 wherein the tube is an artillery aeroshell.

5. The system of claim 1 wherein said wedge is at least one ring segment.

6. The system of claim 5 wherein said ring segment is forcibly placed against the inside surface of the first end of the hollow cylindrical structural member.

7. The system of claim 6 further comprising at least one second ring segment, said second ring segment forcibly placed against the inside surface of the second end of the hollow cylindrical structural member.

8. A system for reducing shear stress at a hollow cylindrical structural member interface comprising:

a hollow cylindrical structural member having a sidewall, a first end and a second end, the sidewall having an outside surface and an inside surface, said member being subjected to a longitudinal compressive load that induces movement of the sidewall in a first direction; and a wedge means forcibly placed against the first end, said wedge means operable to create a transverse compressive force on the sidewall in the first direction, so as to reduce shear stress at the hollow structural member interface.

9. The system of claim 8 wherein said hollow structural member is a material selected from the group comprising of metals, alloys, plastics and composites.

10. The system of claim 8 wherein said wedge means is a driving wedge forcibly placed against a mating wedge bonded to said first end of said structural member using a bolt and nut fastener.

11. The system of claim 8 wherein said, wedge means is a driving wedge forcible placed against a support block fixedly attached a distance apart from said side wall.

12. The system of claim 8 wherein said wedge means is forcibly placed against the inside surface of the first end of the hollow cylindrical structural member.

13. The system of claim 8 wherein the hollow cylindrical structural member is an artillery aeroshell.

14. A method for reducing shear stress proximal to an interface of a hollow cylindrical structural member which comprises:

applying a transverse compressive force in a first direction against a sidewall of a hollow cylindrical structural member subjected to a longitudinal compressive load, the longitudinal compressive load causing deflection of the sidewall in the first direction, so as to attenuate the tendency of the sidewall to deflect in the first direction and reduce a shear stress proximal to an interface of said structural member in contact with the longitudinal compressive load.

15. A method for reducing shear stress, as recited in claim 14, wherein the step of applying the transverse compressive force includes the use of at least one wedge.

16. A method for reducing shear stress, as recited in claim 14, wherein the hollow cylindrical structural member is an artillery aeroshell.

17. A method for reducing shear stress, as recited in claim 14, wherein the hollow cylindrical structural member is a material selected from the group consisting of metals, alloys, plastics and composites.

18. A method for reducing shear stress at an interface of a metal matrix composite hollow cylindrical structural member which comprises:

applying a transverse compressive force in a first direction against a sidewall of a metal matrix composite hollow cylindrical structural member subjected to a longitudinal compressive load, the longitudinal compressive load causing deflection of the sidewall in the first direction, so as to attenuate the tendency of the sidewall to deflect in the first direction and reduce a shear stress proximal to an interface of said structural member in contact with the longitudinal compressive load.

19. A method for reducing shear stress, as recited in claim 18, wherein the step of applying the transverse compressive force includes the use of at least one wedge.

20. A method for reducing shear stress, as recited in claim 18, wherein the metal matrix composite hollow cylindrical structural member is an artillery aeroshell.

* * * * *